US005426853A

United States Patent [19]

McNinch

[11] Patent Number: 5,426,853

[45] Date of Patent: Jun. 27, 1995

[54] METHOD OF SHAVING AND IMPROVED SHAVER

[76] Inventor: Herbie McNinch, 1003 Austin St., P.O. Box 603, George West, Tex. 78022

[21] Appl. No.: 207,637

[22] Filed: Mar. 9, 1994

[51] Int. Cl.[6] ..... B26B 21/22

[52] U.S. Cl. ..... 30/89; 30/48; 30/87

[58] Field of Search ..... 30/30, 34.05, 34.1, 30/47-50, 57, 85-89

[56] References Cited

U.S. PATENT DOCUMENTS 2,587,964 3/1952 Burns ..... 30/30

4,791,724 12/1988 Dumas ..... 30/89

*Primary Examiner*—Douglas D. Watts

*Attorney, Agent, or Firm*—Stevens, Davis, Miller & Mosher

[57] ABSTRACT

An improved shaver having a bifurcated body; an adjustable handle attached to the center of said body, said adjustable handle and said body forming a Y-shape; and at least two holders, each of said holders being sized and shaped for holding razor blades attached to the ends of the body by rotators, each rotator being attached to the center of the back portion of one of the holders. Such a shaver can be used in a method for shaving in which the user holds one shaver in each hand and shaves a portion of the human body with both hands simultaneously, using the shavers in both hands.

6 Claims, 4 Drawing Sheets

METHOD OF SHAVING AND IMPROVED SHAVER

The present invention relates to an improved method of shaving and to an improved hand held manual shaver.

BACKGROUND OF THE INVENTION

Most adult humans remove unwanted hair from their bodies. The removal method of choice of most people is to shave with a razor. In general, men shave their faces. Women shave various parts of their bodies, including underarms and legs, to remove excess hair. However, there are many drawbacks to conventional razors.

One drawback is the size of the razor head. A standard razor blade, either disposable or replaceable, generally has a shaving surface of less than two inches. Razor blades that have two cutting surfaces, such as double edged razors, do not significantly increase this shaving surface, since the cutting edges are parallel and the second edge merely reshaves that which was shaved by the first edge, making the cut "closer".

Due to the small shaving surface available in conventional shavers, a considerable amount of time is often necessary to effectively remove all (or most) unwanted hair.

A second drawback is the rigidity of the razor head. In conventional razors, when the razor head of a hand held razor is mounted to the handle thereof, the only movement, if any, in the razor head during use is in one direction. Thus the contours of the human body become difficult to shave closely, and repeated strokes of the razor over a given area from different directions becomes necessary. This also increases the time necessary for the use to effectively remove all (or most) unwanted hair.

BRIEF SUMMARY OF THE INVENTION

An object of the present invention is to provide an improved shaving device which overcomes the drawbacks discussed above.

Another object of the present invention is to provide a more effective method of shaving, in which the shaving time is decreased and the shaving efficiency is increased.

These objects are achieved by the present invention as discussed below with reference to the drawings.

BRIEF DESCRIPTION OF THE DRAWINGS

FIG. 1A is a top view of a shaving device of the present invention.

FIG. 1B is a front view of the rotators of the device of FIG. 1A.

FIG. 1C is a side view of the rotators of FIG. 1A.

FIG. 1D is an enlarged schematic representation of a rotator of the present invention.

FIG. 3A shows an attachment for use when the razor blade is a disposable razor or when the entire razor is to be attached to the device.

FIG. 3B shows an attachment for use when the razor blade is a conventional slide-on cartridge.

FIG. 3C shows an attachment for use when the razor blade is a conventional clip-on cartridge.

In FIG. 8A, the attachment of FIG. 3B or 3C is used.

In FIG. 8B, the attachment of FIG. 3A is used.

The present invention will be further discussed below with reference to these drawings, in which the same reference numeral indicates an equivalent element.

DETAILED DESCRIPTION OF THE INVENTION

Figure 1:
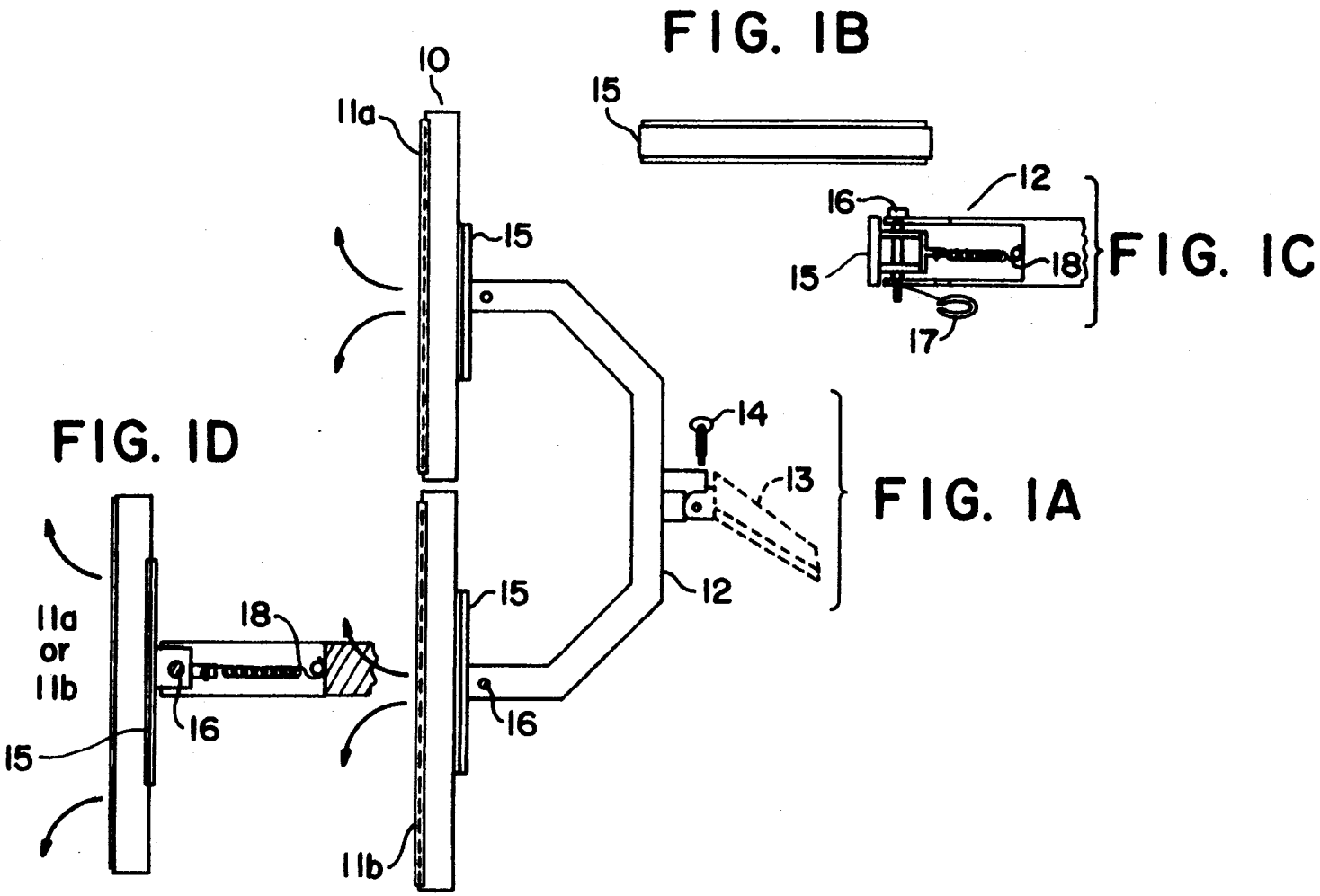
FIGS. 1A–1D show one embodiment of the present invention.

One embodiment of the present invention is shown in FIG. 1A, in which the razor generally is identified by numeral 10. The razor 10 includes an adjustable handle 13 having at one thereof a non-corrosive bifurcated body 12 and two holders 11*a* and 11*b* for holding conventional razor blades (not shown). A razor blade (not shown) is attached to each of holders 11*a* and 11*b* in a conventional manner on the side opposite the side to which the holder 11*a* or 11*b* is attached to the rotator 15. In the rest of this discussion, reference will be made to holder 11*a*. As is clear, the discussion is applicable also to holder 11*b*, which has the same structure as holder 11*a*. The bifurcated body 12 can be made of, for example, a non-corrosive metal or a plastic. The bifurcated body 12 is attached in its center to one end of adjustable handle 13 by an adjustment bolt 14, which can be loosened and tightened to allow for modification of the angle of the handle 13 relative to the bifurcated body 12, to form a Y-shape. At the end of each arm of bifurcated body 12 is a rotator 15, to which a holder 11*a* is attached. FIG. 1B shows the portion of the rotator 15 to which the holder 11*a* is attached. The handle 13 optionally is threaded (not shown) at the other end to allow an extension handle (not shown) to be added.

FIGS. 1C and 1D show side views of the means of attachment of a rotator 15 in FIG. 1A. As shown in FIGS. 1C and 1D, the rotator 15 comprises a rotator pin 16, a rotator keeper 17 and a spring 18 for returning the rotator (and thus the holder and the razor blade) to a neutral position (generally perpendicular to the end of the arm of the bifurcated body) when the razor is not in use.

In use, the rotators 15 of the shaving device 10 allow the holders 11*a* and *b* (and thus the cutting surfaces-see FIG. 4 discussed below) to rotate as necessary in the direction of the arrows in FIG. 1*a*) to contour to the surface being shaved to allow for a closer shave. Since each cutting surface is mounted on its own rotator, the rotation of one surface is independent of the other surface, and areas of the body which are not uniformly contoured can be adequately shaved.

Figure 2:
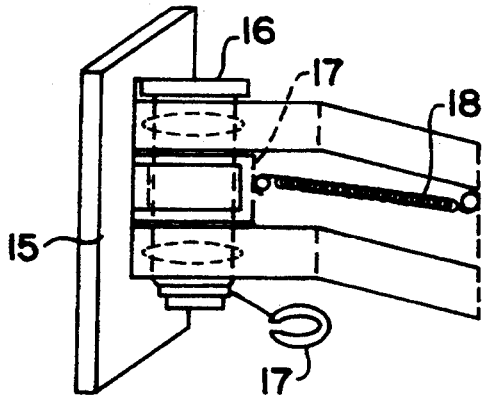
FIG. 2 is a plan schematic presentation of the rotator of FIG. 1D when said rotator is contoured to an area to be shaved.

FIG. 2 shows a top view of a rotator 15 is in use and rotated to shave a contoured area of the body. When a razor blade comes into contact with a contoured portion of the body, one end of the corresponding rotator 15 receives more pressure than the other, thereby pushing the rotator pin 16 and the keeper 17, stretching the spring 18, and allowing for better contouring of and reducing the time spent on the surface to be shaved. In FIG. 2, for example, the contour being shaved is such that one end of the rotator 15 is pushed more than the other end thereof. The rotator pin 16, keeper 17 and spring 18 absorb the additional pressure, and the angle of the rotator is temporarily modified accordingly. When the device is not in use, the rotators return to a position in which the spring is not stretched, as shown in FIG. 1D.

Figure 3A:
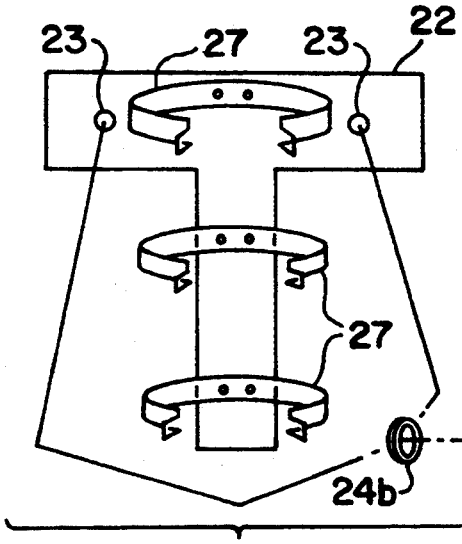
FIGS. 3A–3C are front views of attachments for use with the device of FIG. 1A when different types of razor blades are to be used.
Figure 3B:
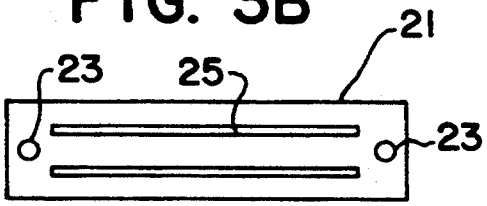
Figure 3C:
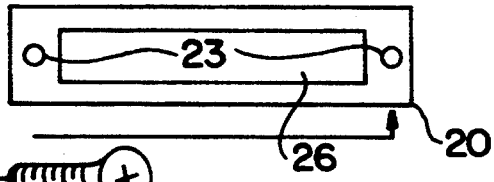

As would be clear to one skilled in the art, the structure of holder 11*a* is dependent on the type of razor blades to be attached thereto. FIGS. 3A–C show three alternative designs for the holder 11*a* based on the type of razor to be used. Other configurations of holders as necessary for the use of different types of razor blades with the present razor are also considered to be part of the present invention. In FIG. 3A, the holder 11*a* is one for use when a disposable or other handle type razor 35 (FIG. 8B) is to be used. This specific holder is identified by numeral 22 in FIG. 3A for clarity. In use, the handle of the razor is secured to the holder 22 within circular holders 27 which keep the razor in place, as shown in FIG. 8B. The holder 22 is secured to the rotator 15 by counter-sunk screws 24*a* and washers 24*b* which are placed in threaded holes 23. The handle type razor can then be snapped in and out of the holder 22.

Figure 8A:
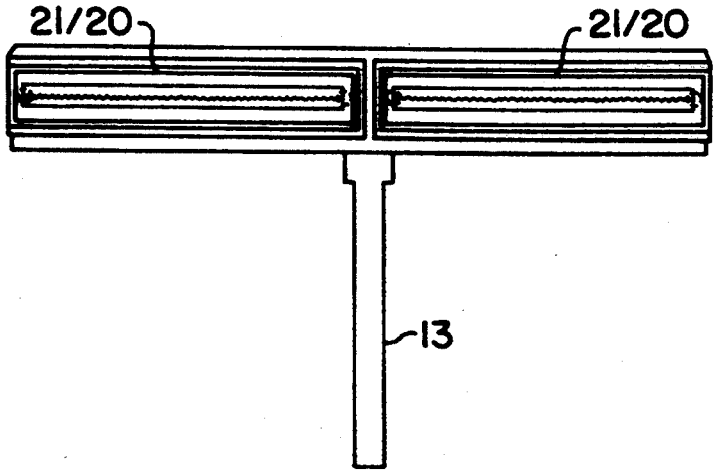
FIGS. 8A and 8B are front and rear views of another embodiment of a device of the present invention.
Figure 8B:
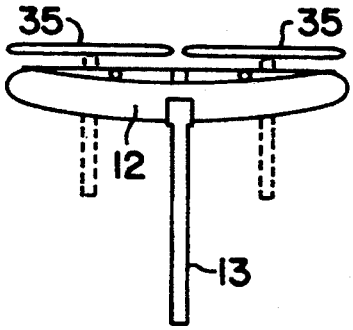

The holder 11*a* shown in FIG. 3B is for use when a conventional slide-on type razor blade cartridge is to be used (see FIG. 8A). The specific holder for use with slide-on type razor blade cartridges is identified by numeral 21 for clarity. The holder 21 is secured to the rotator 15 in the same manner as is the holder 22 of FIG. 3A. That is, holder 21 is secured to the rotator 15 by counter-sunk screws 24*a* and washers 24*b* which are placed in threaded holes 23. The razor cartridge (not shown) is secured to the holder 21 by sliding the cartridge into slots 25, which is the conventional way of securing such razor cartridges. The holder 21 can optionally be molded so that the edge closest to the other holder is bent upward (not shown) to prevent the razor cartridge (not shown) from sliding when the shaver is in use.

The holder 11*a* shown in FIG. 3C is for use when a clip-on type razor cartridge is to be used (see FIG. 8A). This specific holder is identified by numeral 20 for clarity. Holder 20 is secured to rotator 15 in the same manner as is holder 22 of FIG. 3A and holder 21 of FIG. 3B. The razor cartridge is secured to the holder 20 by being clipped into slot 26, which is the conventional way of securing such razor cartridges.

Figure 4:
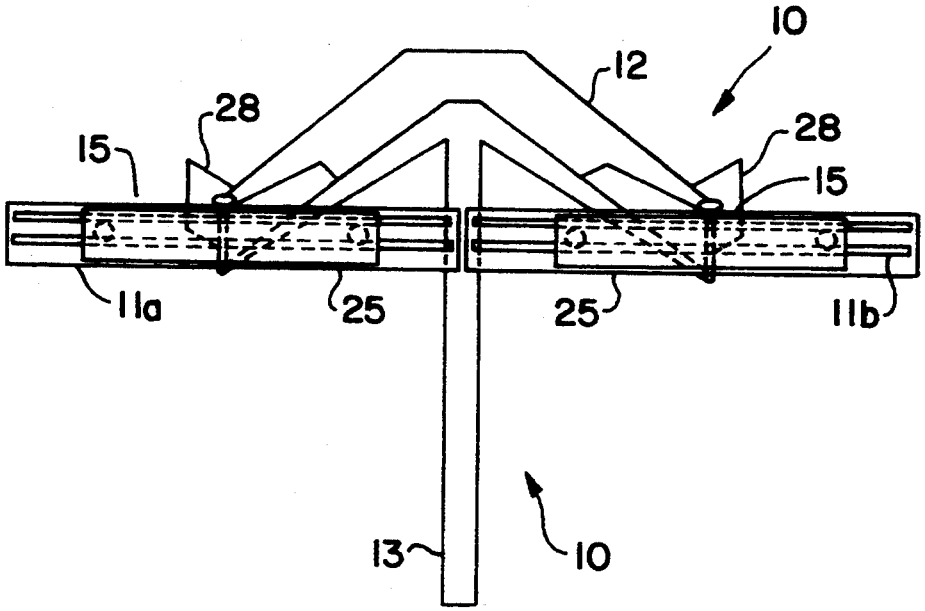
FIG. 4 is a front view of a second embodiment of a device of the present invention.

FIG. 4 is directed to another embodiment of the present invention. The razor 10 further comprises stop pads 28 on the rotators 15, which limit the degree of rotation of the rotators 15 when the razor is in use.

Figure 5:
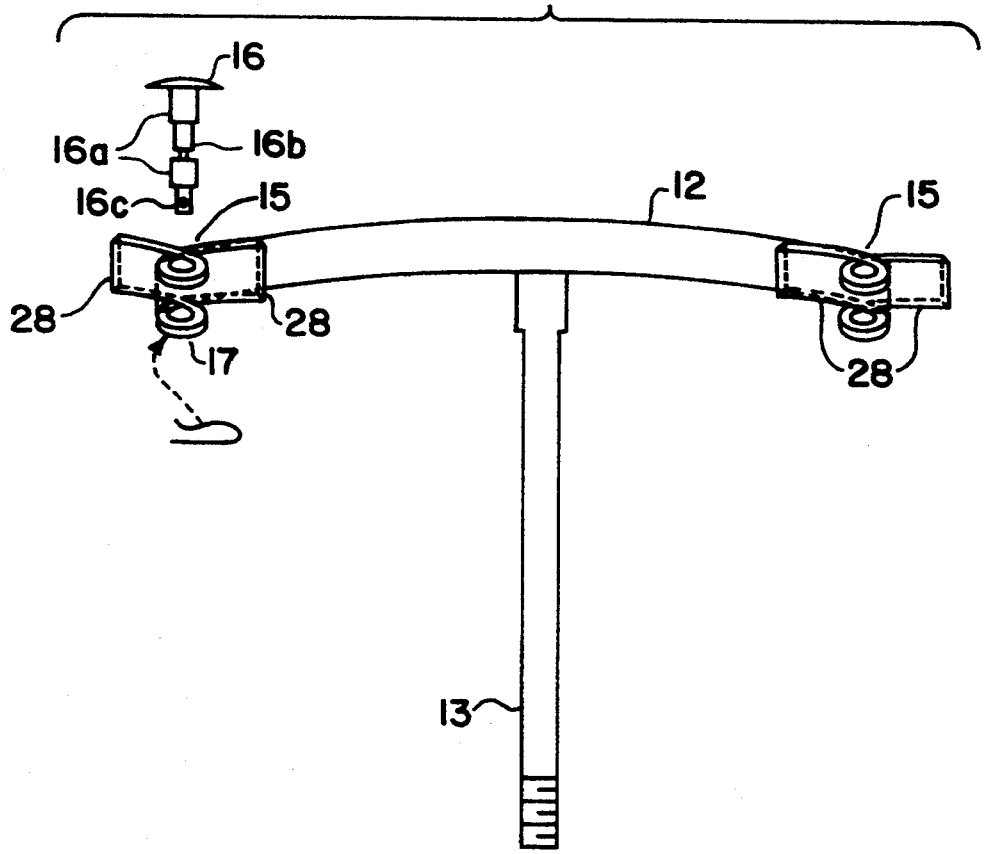
FIG. 5 is a front view of a third embodiment of a device of the present invention.

FIG. 5 illustrates another embodiment of the present invention. In this embodiment, the stop pads 28 limit the rotators 15 to rotation of up to approximately 30° outward and approximately 45° inward. In this Figure, rotator pin 16 is also further illustrated. The rotator pin 16 comprises round bearing surfaces 16*a*, a square spring surface 16*b* and a flat non-rotating surface with a retainer pin hole 16*c*. The bottom of adjustable handle 13 optionally has threads for an extension handle to be added (not shown).

Figure 6:
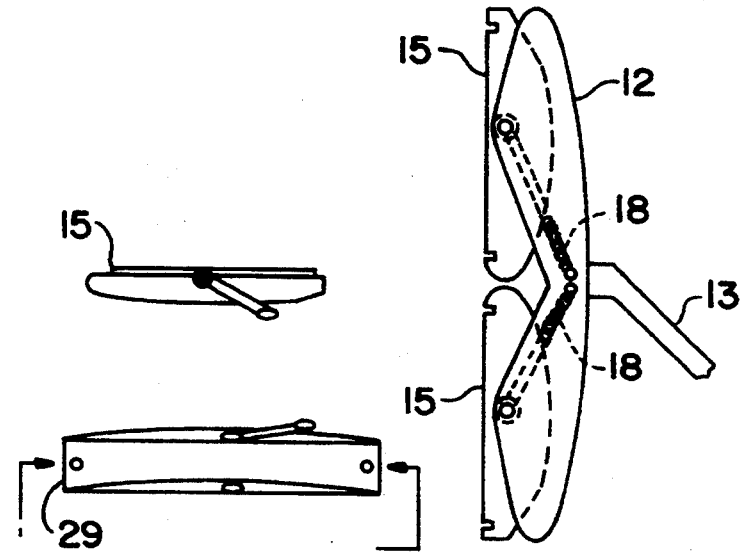
FIG. 6 is a bottom view of a device of a fourth embodiment of the present invention.

FIG. 6 is a bottom view of a shaver of the present invention. In this embodiment, the springs 18 are within the bifurcated body 12. The attachment between a rotator 15 and a cartridge holder 11*a* is also shown.

Figure 7:
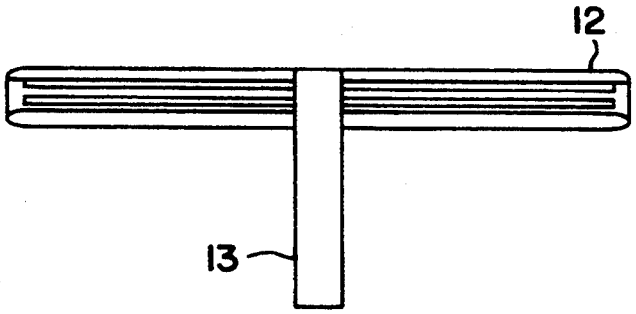
FIG. 7 is a rear view of the device of FIG. 6.

FIG. 7 shows a rear view of a shaver of the present invention.

FIG. 8A shows the present shaver when slide-on or clip-on type razor cartridges are attached thereto. FIG. 8B shows the present shaver when handle type razors are used. A combination of two different types of razor cartridges can also be used in the present invention. When handle type razors are used, the razors can be mounted in such a way that the cutting surfaces are not linear to each other, i.e. that the cutting surfaces are at different heights. This allows for a closer shave of, for example, side burns.

When in use, the shaver of the present invention provides a quicker, more efficient shave than conventional shavers. The two separate shaving edges, each independently rotatable, allow for the entire surface (such as a man's face or a woman's leg) to be shaved more quickly and accurately. The rotation of the shaving edges independently of each other to conform to the contours of the surface being shaved provides a closer, more accurate shave, in which more of the undesired hair is removed more quickly.

In a preferred embodiment of tile present method of shaving, one shaver of the present invention is held in each hand, and both shavers are used simultaneously to afford an even quicker shave, since four razor blades are being used instead of one, as is conventional. Since the razor blades rotate independently based on the contours they encounter, there is no need to slow down to cover the contours of the area being shaved, except to overlap slightly to allow for any open space between tile rotators, where there is no cutting surface.

I claim:

1. A shaver comprising:

a bifurcated body;.

an adjustable handle attached to the center of said body, said adjustable handle and said body forming a Y-shape; and at least two holders, each of said holders being sized and shaped for holding razor blades attached to the ends of the body by rotators, each rotator being attached to the center of the back portion of one of the holders and said rotators comprising a spring which allows the rotators to rotate the holders and razor blades.

2. The shaver of claim 1 wherein said rotators timber comprise stopping means to prevent the holders from rotating beyond a preset angle.

3. The shaver of claim 1 wherein the bifurcated body is fabricated from a non-corrosive material.

4. A shaver comprising:

a bifurcated body;

a handle attached to the center of said body, said handle and said body forming a Y-shape; and at least two holders, each of said holders being sized and shaped for holding razor blades attached to the ends of the body by rotators, each rotator being attached to the center of the back portion of one of the holders and said rotators comprising a spring which allows the rotators to rotate the holders and razor blades.

5. The shaver of claim 4 wherein said rotators further comprise stopping means to prevent the holders from rotating beyond a preset angle.

6. The shaver of claim 4 wherein the bifurcated body is fabricated from a non-corrosive material.

* * * * *